US007437120B2

(12) United States Patent
Ruthenberg et al.

(10) Patent No.: US 7,437,120 B2
(45) Date of Patent: Oct. 14, 2008

(54) OPTICAL SENSOR FOR MONITORING MOTION OF A BLANK SHEET

(75) Inventors: Raymond M. Ruthenberg, Toronto (CA); Mark Muzzin, Brampton (CA); John Wojtkowicz, Bath (CA); Karen Lee, Brampton (CA); Michel Loiselle, Brampton (CA); David C. van Wyngaarden, Toronto (CA)

(73) Assignee: Xerox Corporation, Norwalk, CT (US)

( * ) Notice: Subject to any disclaimer, the term of this patent is extended or adjusted under 35 U.S.C. 154(b) by 313 days.

(21) Appl. No.: 11/047,951

(22) Filed: Jan. 31, 2005

(65) Prior Publication Data

US 2006/0171725 A1 Aug. 3, 2006

(51) Int. Cl.
*G03G 15/00* (2006.01)

(52) U.S. Cl. ..... 399/396; 399/395

(58) Field of Classification Search ..... 399/16, 399/396, 395

See application file for complete search history.

(56) References Cited

U.S. PATENT DOCUMENTS 3,511,150 A * 5/1970 Aroyan et al. ..... 250/559.02
4,197,584 A * 4/1980 Blazek ..... 356/394
5,132,791 A * 7/1992 Wertz et al. ..... 348/88
5,555,084 A * 9/1996 Vetromile et al. ..... 399/16
5,557,396 A 9/1996 Ishizuka et al. ..... 356/28.5
5,794,176 A * 8/1998 Milillo ..... 702/150
6,201,901 B1 * 3/2001 Zhou et al. ..... 382/306
6,201,937 B1 * 3/2001 Folkins ..... 399/49
6,212,288 B1 * 4/2001 Sarpeshkar et al. ..... 382/107
6,533,268 B2 3/2003 Williams et al. ..... 271/228
6,578,844 B2 * 6/2003 Acquaviva et al. ..... 271/228
6,741,335 B2 5/2004 Kinrot et al. ..... 356/28
6,895,210 B1 * 5/2005 Quesnel ..... 399/395
6,898,382 B2 * 5/2005 Shibaki ..... 399/16
6,988,725 B2 * 1/2006 Rapkin ..... 271/227
2005/0012771 A1 * 1/2005 Leung et al. ..... 347/19

* cited by examiner

*Primary Examiner*—Anthony H. Nguyen
(74) *Attorney, Agent, or Firm*—R. Hutter

(57) ABSTRACT

An apparatus monitors the motion of sheet, such as in a digital printer. An optical sensor is capable of recording an image in a two-dimensional array of pixels, and has acuity to recognize a terrain of a small area on a sheet that is substantially blank to a human eye. The optical sensor views a portion of a sheet moving in a process direction through a path. A detection system compares at least two recorded terrain images from the sheet, thereby directly measuring velocity and direction of the sheet.

17 Claims, 3 Drawing Sheets

OPTICAL SENSOR FOR MONITORING MOTION OF A BLANK SHEET

TECHNICAL FIELD

The present disclosure relates to optical sensing systems to detect the motion of a surface, such as of a sheet moving within a printing apparatus.

BACKGROUND

There are many contexts in which a substantially flat substrate, such as a sheet of paper, is desired to be moved at a precise velocity and direction. A typical context is in printing, either of the digital or traditional types. In the xerographic context, for example, the sheet must move at a precisely-determined velocity to contact a developed image at a photoreceptor, to receive the image at a precise location thereon. Also, the sheet must not be skewed, or otherwise laterally displaced along a main process direction, so the received image is not skewed or improperly placed on the final print.

At high levels of precision, as would be required in a high-speed printing apparatus, the velocity of a sheet moving through a machine cannot be directly assumed by monitoring the motion of parts within the machine, such as rollers which contact and impart motion to the sheet at various times. Even slightly deformable rolls, for instance, do not have an assumable circumference by which the velocity of a sheet in contact therewith can be calculated. Also, brushless DC motors, as are often used in printing machines, are often incapable of operating at sufficiently precise rotational speeds.

In most common systems for monitoring the speed of a sheet passing through a machine, a lead edge of the moving sheet is used, in one of various ways, to interact with a monitoring device, such as for example measuring when the lead edge breaks one or more light beams as it moves. One problem common to such a system is taking into account the skew or other displacement of the sheet relative to an expected path through the machine.

In the prior art, U.S. Pat. No. 5,557,396 discloses a system for using a measured Doppler shift of light reflected from a moving sheet, in order to measure the velocity of the sheet. U.S. Pat. No. 6,741,335 discloses another system for determining the speed of a moving sheet. U.S. Pat. No. 6,533,268 discloses a system that contacts a moving sheet to obtain a desired lateral registration and deskewing.

SUMMARY

According to one aspect, there is provided an apparatus for interacting with a sheet, comprising a first optical sensor, capable of recording an image in a two-dimensional array of pixels, and having acuity to recognize a terrain of a small area on a sheet which is substantially blank to a human eye. The first optical sensor is disposed to view a portion of a sheet moving in a process direction through a path. A detection system compares at least two recorded terrain images from the sheet, thereby determining a velocity of the sheet.

DETAILED DESCRIPTION

Figure 1:
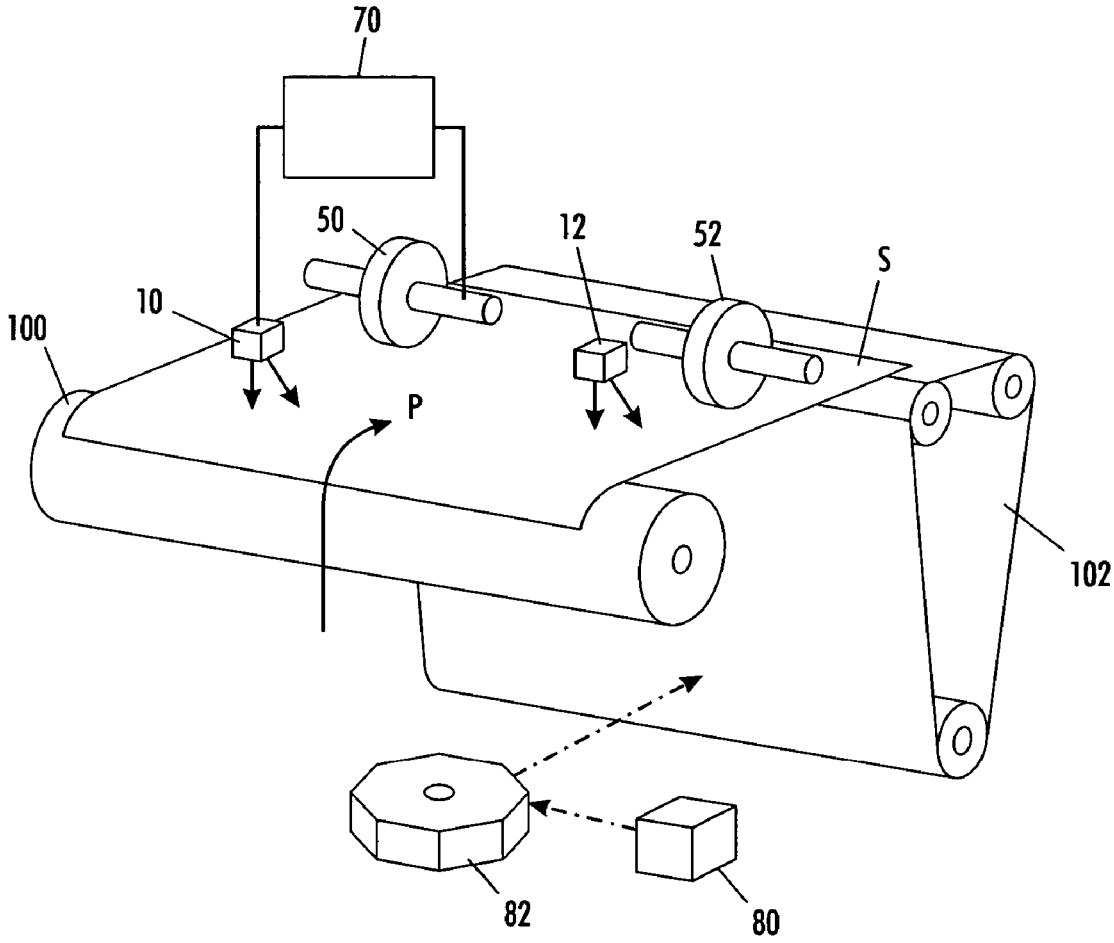
FIG. 1 is a simplified perspective view of a portion of an electrostatographic or xerographic printing apparatus.

FIG. 1 is a simplified perspective view of a portion of an electrostatographic or xerographic printing apparatus. As shown, a sheet S is at the moment of FIG. 1 coming off of a main roll 100 and heading for an electrostatographic image receptor such as photoreceptor belt 102, from which the sheet receives toner particles in imagewise fashion, as is familiar in the art. The main roll 100 contacts the sheet S and causes the sheet to move generally in process direction P. Main roll 100 and photoreceptor 102 can be driven by independently-controllable motors (not shown) of various types. Before contacting the photoreceptor, however, it is desired to ensure that the sheet S is moving at a precisely-determined speed and without skew or lateral displacement relative to the desired process direction P. In a high-speed system, it is generally known to provide a deskewing system, meaning a system by which the moving sheet S is contacted in a precisely-controlled manner by one or more rollers, here indicated as 50, 52, to counteract any detected skew or lateral displacement before the sheet S contacts photoreceptor 102. A practical example of a deskewing device can be found in U.S. Pat. No. 6,533,268, referenced above (and also in patents cited therein). For present purposes, the two rollers 50, 52 can be taken to represent any more complex mechanical deskewing system, which may include flippers, helical rollers, or other structures.

Further shown in FIG. 1 is a first image sensor 10 and second image sensor 12, each disposed to view a series of small areas of sheet S as the sheet S passes therepast. The image sensors 10, 12 are disposed just upstream of the rollers 50, 52 of the deskewing device.

Figure 2:
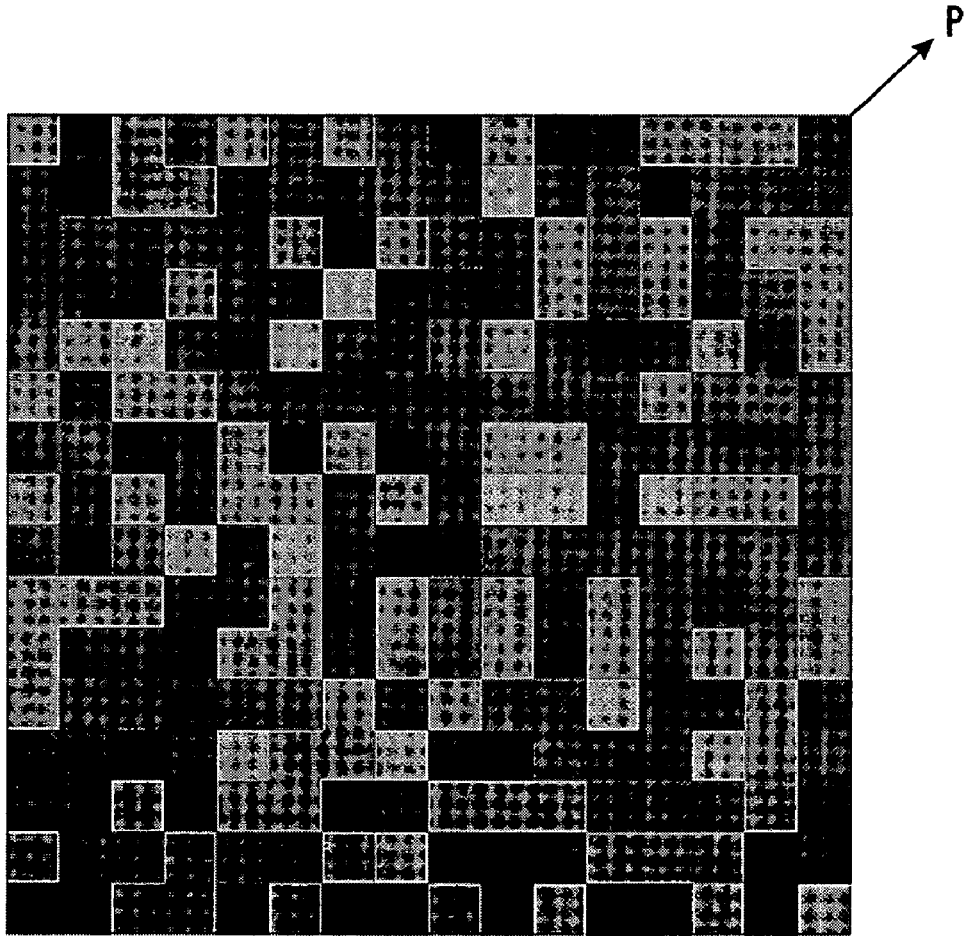
FIG. 2 is a diagram of an example of a single small image recorded by an image sensor.

FIG. 2 is a diagram of an example of a single small image recorded by image sensor 10, according to one practical embodiment. The image is derived from the arrangement of photosensors in the image sensor. As shown, the photosensors record, at any time, a square array of 256 pixels. In a practical embodiment, each pixel represents a grayscale on a scale of 0 to 255, as recorded by each photosensor. This acuity of grayscale recording is sufficient to recognize patterns or "terrain" in the small area on sheet S being viewed at any time. As shown in the example image of FIG. 2, a perceptible pattern of relatively dark and light areas is apparent even in a small area of a sheet which is blank to a casual observer: in the present embodiment, no special pattern or marks need be printed on sheet S. As used herein, a "terrain" of a small area of a sheet can be defined as an arrangement of relatively dark and light areas, perceptible by an image sensor having sufficient acuity, which enables a fixed point to be identified on the sheet, as the sheet moves past the area viewed by the image sensor.

In this way, if a succession of 256-pixel images are recorded at a predetermined frequency by the image sensor, the resulting images over time can be compared to monitor directly the motion of the sheet S relative to the image sensor, both in terms of velocity along a process direction P and in terms of any deviation in direction from process direction P. A "detection system" can be provided that performs this recurrent comparison of images to monitor the motion of sheet S, and such systems are available that are built in with optical sensors used in "optical mouse" or "optical tracking engine" technology. The frequency of recording images by each optical sensor is selected by a reasonable estimate of the velocity of sheet S: the frequency should be high enough that the motion of the "terrain" is perceptible in successive images recorded by the optical sensor. A commercially available optical tracking engine, such as available from Logitech®

Corporation, can output image data and 800 spot per inch resolution, and monitor motion of a surface moving at 1000 mm/s relative thereto.

In the embodiment shown in FIG. 2, the image sensor 10 is arranged so that the array of photosensors is oriented at a diagonal relative to the process direction P; such an arrangement is useful in obtaining accuracy of determining the main velocity along process direction P and also detecting any deviation of motion of the sheet S relative to process direction P.

In the illustrated arrangement, a small area of sheet S can be viewed by the image sensor 10 at any time, including while another portion of the sheet S is in contact with any other "moving device," i.e., a structure which imparts motion to the sheet S, such as main roll 100 or photoreceptor 102, or when the sheet S is being contacted and/or manipulated by a deskewing device such as roller 50, 52. A control system, such as generally indicated as 70, can take as an input the observed motion of sheet S, as recorded by a sensor such as 10 or 12, and in turn influence the operation of one or more rollers 50, 52 or other deskewing devices. (For clarity in FIG. 1, control system 70 is shown connected only to optical sensor 10 and roller 50.) By viewing sheet S while it is being moved and/or deskewed, the image sensor 10 can thus monitor whether the moving device or deskewing device is successfully operating. Also, the information from sensors 10, 12 can be used in a feedback control system (also through control system 70 as shown) with a motor associated with either roller 100 or photoreceptor 102, to ensure the sheet S moves at a constant velocity through process direction P.

Also shown in FIG. 1 is a laser 80 that emits a beam that reflects off rotating mirror 82, forming a raster line on the photoreceptor 102, in a manner familiar in electrostatographic printing. Information derived from the sensors such as 10, 12 can be used to influence the imagewise modulation of the laser 80, thereby influencing the placement of an electrostatographic image on photoreceptor 102, which in turn is developed (by a development unit, not shown) and transferred to sheet S. The system as described could further be used in conjunction with image placement of any type of print engine placing an image on a sheet, besides an electrostatographic one, such as including an ink-jet printhead.

The illustrated system uses two image sensors 10, 12. Useable coordinate data from each sensor starts when the lead edge of the moving sheet S is detected by the image sensor, and the distance detected from the one image sensor prior to the start of detection on the other image sensor yields data from which can be calculated the lead edge skew of the sheet S. Continuing to track the data reported from each sensor 10, 12 yields data relating to the velocity, rotation and lateral tracking of the sheet S. This data is also used for feedback during deskew and trail edge skew detection as the sheet leaves the areas monitored by the sensors.

In an alternate embodiment, an optical sensor such as 10 or 12 is mounted such that the viewing field of the sensor could detect the edge of the moving sheet S to provide, as needed, a side edge registration monitoring system. If two sensors were so mounted relative to the side edge of the sheet, the data reported from the sensors and the known input velocity of the translating mechanism would yield data relating to sheet skew, velocity, rotation, lateral tracking, and lateral position.

Figure 3:
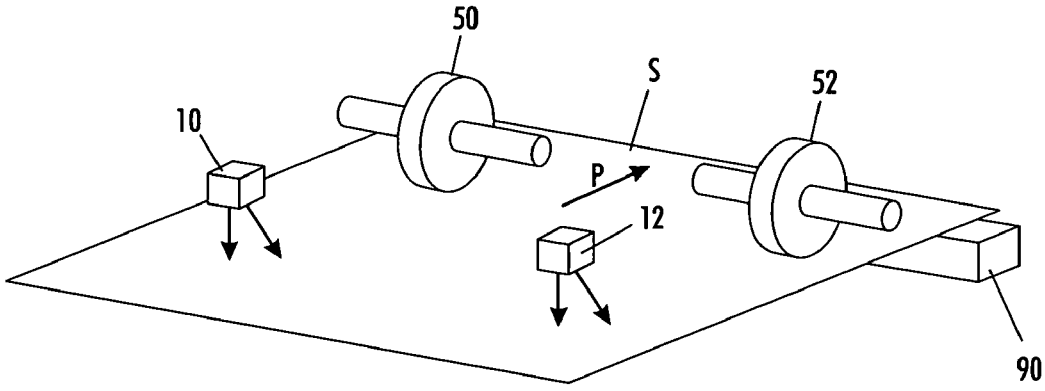
FIG. 3 is a simplified perspective view showing the use of image sensors in the context of input scanning.

FIG. 3 is a simplified view showing the use of image sensors 10,. 12 as described above, in the context of input scanning, as opposed to the printing context of FIG. 1. Sensor bar 90, of a basic design familiar in the art, includes an array (not shown) of pixel-sized photosensors that record light reflected from small areas of sheets S as the sheet moves therepast, propelled by a moving device such as including rollers (not shown): the basic architecture of an "image input scanner" is familiar in digital copiers and facsimile machines, and may include reductive optics to record the image on a single chip smaller than the width of sheet S.

As can be seen in FIG. 3, the downward-facing side of sheet S is placed to have an image thereon recorded by sensor bar 90, while the upward-facing side of sheet S is monitored by image sensors 10, 12 which function in the same manner as described above with regard to FIG. 1. The data from image sensors 10, 12 can be used either to inform mechanical deskewing of the sheet S, such as by rollers 50, 52, which function just as described with FIG. 1, or can be used to influence the use of deskewing algorithms applied to recorded image data originating from sensor bar 90.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for interacting with a sheet, comprising a first optical sensor, the optical sensor being capable of recording an image in a two-dimensional array of pixels, the first optical sensor having acuity to recognize a terrain of a small area on a sheet which is substantially blank to a human eye, the small area having no printed marks thereon;

the first optical sensor being disposed to view a portion of a sheet moving in a process direction through a path; and a detection system for comparing at least two recorded terrain images from a sheet, thereby determining a velocity of the sheet.

2. The apparatus of claim 1, the detection system further comparing at least two recorded terrain images from a sheet, thereby determining a deviation in motion of the sheet relative to the process direction.

3. The apparatus of claim 1, the first optical sensor viewing an area of less than 4 mm on the sheet.

4. The apparatus of claim 1, the first optical sensor recording an array of more than 64 pixels.

5. The apparatus of claim 1, the two-dimensional array being oriented at a diagonal relative to the process direction.

6. The apparatus of claim 1, further comprising a moving device for contacting the sheet and causing motion of the sheet.

7. The apparatus of claim 1, the moving device including at least one of a rotatable roll and a rotatable belt in contact with a portion of the sheet.

8. The apparatus of claim 1, wherein the moving device contacts a first portion of the sheet while the first optical sensor views a second portion of the sheet.

9. The apparatus of claim 1, further comprising a deskewing device for contacting the sheet and moving the sheet in a direction not parallel with the process direction.

10. The apparatus of claim 9, the deskewing device being operatively associated with the first optical sensor.

11. The apparatus of claim 9, wherein the deskewing device contacts a first portion of the sheet while the first optical sensor views a second portion of the sheet.

12. The apparatus of claim 1, further comprising a print engine for placing an image on the sheet.

13. The apparatus of claim 12, the print engine including an electrostatographic image receptor.

14. The apparatus of claim 12, the detection system influencing the print engine in placement of an image on the sheet.

15. The apparatus of claim 12, the first optical sensor viewing a first portion of the sheet while a second portion of the sheet receives an image from the print engine.

16. The apparatus of claim 1, further comprising an image input scanner.

17. The apparatus of claim 16, the detection system influencing image data output by the image input scanner.

* * * * *